US009724705B2

(12) United States Patent
Lee et al.

(10) Patent No.: US 9,724,705 B2
(45) Date of Patent: Aug. 8, 2017

(54) SIZE SEPARATING DEVICE FOR CARBON NANOTUBE AGGLOMERATE USING MAGNETIC FIELD, AND SEPARATING AND OBTAINING METHOD OF DISPERSED CARBON NANOTUBE USING THE SAME

(71) Applicants: RESEARCH & BUSINESS FOUNDATION SUNGKYUNKWAN UNIVERSITY, Suwon-si (KR); JC CORP., Siheung-si (KR)

(72) Inventors: Dong Hyun Lee, Yongin-si (KR); Seung Yong Son, Busan (KR); Doo Kyoo Kim, Seoul (KR); Ki Chull Shin, Siheung-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 651 days.

(21) Appl. No.: 14/141,856

(22) Filed: Dec. 27, 2013

(65) Prior Publication Data

US 2014/0183139 A1 Jul. 3, 2014

(30) Foreign Application Priority Data

Dec. 27, 2012 (KR) ..... 10-2012-0155238

(51) Int. Cl.

*B03C 1/23* (2006.01)
*B03C 1/28* (2006.01)
*B03C 1/01* (2006.01)
*B03C 1/033* (2006.01)

(52) U.S. Cl.

CPC ..... *B03C 1/23* (2013.01); *B03C 1/01* (2013.01); *B03C 1/0335* (2013.01); *B03C 1/288* (2013.01); *B03C 2201/18* (2013.01)

(58) Field of Classification Search

CPC ..... B03C 1/23; B03C 1/288; B03C 1/0335; B03C 1/01; B03C 2201/18

See application file for complete search history.

(56) References Cited

U.S. PATENT DOCUMENTS 8,357,294 B2 * 1/2013 Danov ..... B03C 1/10 209/232

FOREIGN PATENT DOCUMENTS

| | | | |
|---|---|---|---|
| JP | 2010-138015 | A | 6/2010 |
| KR | 10-2010-0051927 | A | 5/2010 |
| KR | 10-2012-0041803 | A | 5/2012 |

* cited by examiner

*Primary Examiner* — David A Reifsnyder
(74) *Attorney, Agent, or Firm* — NSIP Law

(57) ABSTRACT

A size sorting device for carbon nanotube agglomerate and a method for separating and collecting dispersed carbon nanotubes using the size sorting device are provided. The size sorting device and method for separation and collection may use a magnetic field for separating and collecting dispersed carbon nanotubes.

10 Claims, 1 Drawing Sheet

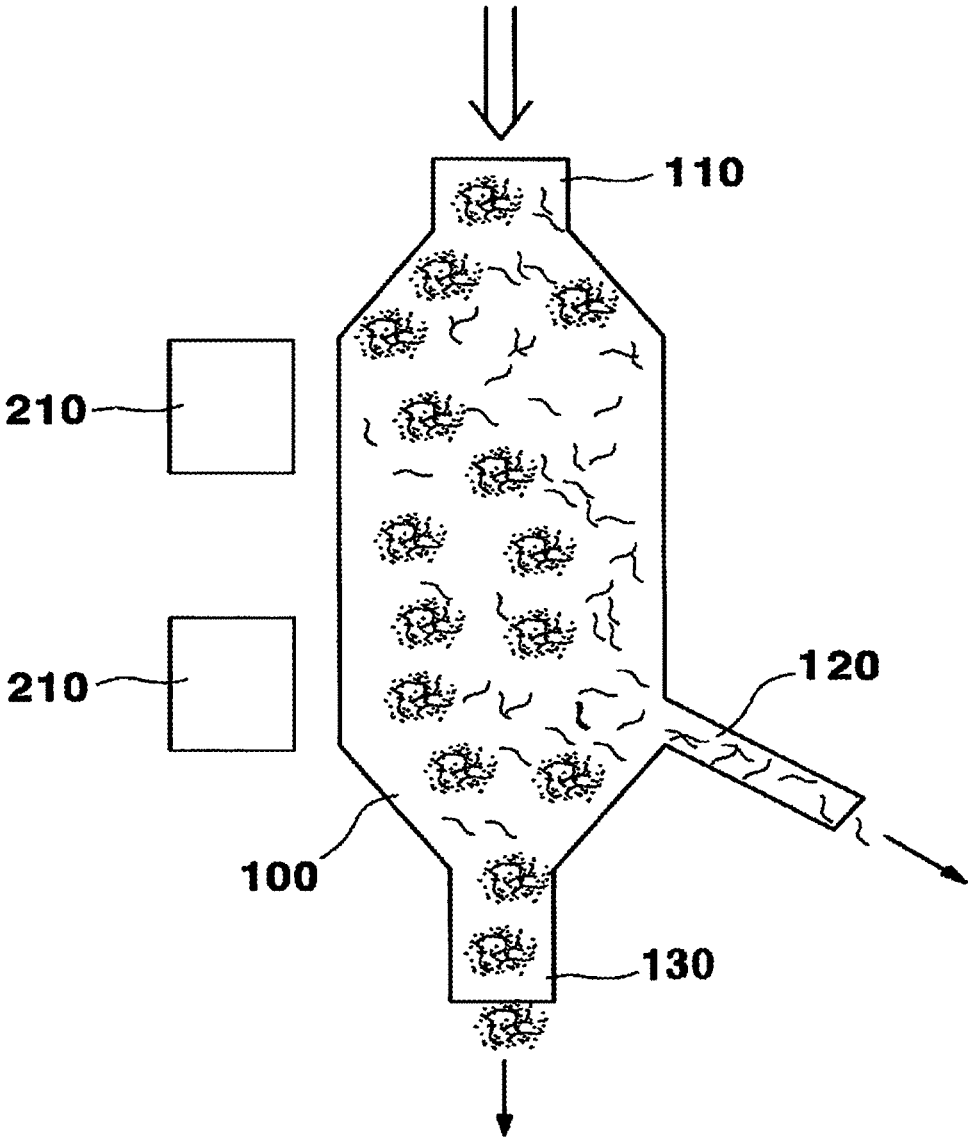
110
210
210
120
100
130

SIZE SEPARATING DEVICE FOR CARBON NANOTUBE AGGLOMERATE USING MAGNETIC FIELD, AND SEPARATING AND OBTAINING METHOD OF DISPERSED CARBON NANOTUBE USING THE SAME

CROSS-REFERENCE TO RELATED APPLICATIONS

This application claims the benefit under 35 USC 119(a) of Korean Patent Application No. 10-2012-0155238 filed on Dec. 27, 2012, the entire disclosures of which is incorporated herein by reference for all purposes.

BACKGROUND

1. Field

The following description relates to a size sorting device for carbon nanotube agglomerate, and a method for separating and collecting dispersed carbon nanotubes using the same.

2. Description of Related Art

A carbon nanotube (CNT) is a material composed of carbon atoms bonded to each other in hexagonal honeycomb patterns, forming a tube shape as a whole. Additionally, carbon nanotubes feature high anisotropy and have various structures such as single-walled structures, multi-walled structures, bundle structures, etc. Carbon nanotubes include nanomaterials having a diameter on a nanometer scale (1 nm=one billionth of 1 m), and generally have extraordinary mechanical and electrical properties, excellent field emission properties, high efficiency properties like hydrogen storage mediums, among other unique properties.

Carbon nanotubes may be synthesized by various methods such as electric discharge, thermal decomposition, laser deposition, plasma chemical vapor deposition, thermochemical vapor deposition, and electrolysis. Since most carbon nanotubes exist in bundle forms in the stage of synthesis, it is important to separate and disperse the carbon nanotubes one by one in order to utilize the excellent mechanical and electrical properties of the carbon nanotubes.

Typically, as a way to disperse carbon nanotubes in a liquid, a physical dispersion method such as an ultrasonic process is used. Such a physical dispersion method using an ultrasonic process may include a method of putting a single-walled carbon nanotube agglomerate in acetone and dispersing the carbon nanotubes in the acetone using the ultrasonic process. In addition to performing the ultrasonic process, the method includes improving hydrophilic properties of carbon nanotubes by adding a material such as a surfactant to the solvent. For example, Korean Patent Laid-open Publication No. 2010-0051927 describes a combined pulverization and dispersion system enabling dispersion of carbon nanotubes. These carbon nanotube dispersion methods, however, may not only lack dispersion effects but may also cause damage to the carbon nanotubes.

Further, conventional techniques of collecting and separating certain nanotubes by using a magnetic field are not aimed at collecting carbon nanotubes dispersed from carbon nanotube agglomerates, but are mainly intended to separate carbon nanotubes free of metal impurities by using a magnetic field or to selectively separate only semiconducting or metallic carbon nanotubes that react to a magnetic field.

In order to manufacture a carbon nanotube complex with vast market potential, it is required to acquire excellent physical properties or electrical conductivity with a minimum use of carbon material. Accordingly, it is important to obtain a high degree of dispersion of carbon materials. As an example, if ITO (Indium Tin Oxide), most of which is imported, can be replaced with a carbon nanotube polymer film, it may be possible to obtain an import-substituting effect amounting to about ₩ 1.3 trillion for 5 years. Moreover, such high efficiency carbon nanotube dispersion techniques may find applications to various fields such as conductive polymer, conductive e-paint, electromagnetic field absorber, and products such as a tennis rackets or a racing bicycles, etc., thus producing higher added value.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a device for sorting a carbon nanotube agglomerate includes a vessel; an inlet part placed at an upper portion of the vessel; a first collection part placed at a lower portion of the vessel facing the inlet part; a second collection part placed at a lower portion of the vessel facing the inlet part; and one or more electromagnets placed at an external wall surface at one side of the vessel.

The vessel may not affected by a magnetic field; the inlet part may be configured to introduce into the vessel a mixed solution containing the carbon nanotube agglomerate having a magnetic particle attached thereto; the first collection part may be configured to collect dispersed carbon nanotubes; and the second collection part may be configured to collect the non-dispersed carbon nanotube agglomerate, wherein the mixed solution may be subjected to a dispersion process prior to being introduced into the vessel.

The first collection part may be placed to face the electromagnets.

The vessel may be made of glass, quartz, metal oxide, ceramic, polymer, polymer complex, carbon material, rock or a metal-containing material which is not capable of being magnetized in a magnetic field.

The one or more electromagnets may include two or more electromagnets and a magnetic field is applied alternately to the vessel by each of the two or more electromagnets.

In another general aspect, a method for separating and collecting dispersed carbon nanotubes includes attaching a magnetic particle to a carbon nanotube agglomerate to prepare a mixed solution; introducing the mixed solution into a vessel using an inlet part of the vessel; and collecting dispersed carbon nanotubes by a first collection part of the vessel while collecting a non-dispersed carbon nanotube agglomerate by a second collection part of the vessel using a magnetic field.

The method may further include dispersing the carbon nanotube agglomerate in the mixed solution prior to introducing the mixed solution into the vessel, wherein the preparing the mixed solution comprises mixing the carbon nanotube agglomerate having the magnetic particle attached thereto with a fluid.

The fluid may include one or a combination of water, alcohols, organic solvents, surfactant-containing aqueous solution, glycerin, and low-viscosity polymer.

The magnetic particle may include a transition metal oxide.

The transition metal oxide may include one or a combination of iron oxide, cobalt oxide, nickel oxide, chrome oxide, and magnetite.

The magnetic particle may be included in an amount ranging from about 0.1 part by weight to about 20 parts by weight with respect to about 1 part by weight of the carbon nanotube agglomerate.

The magnetic field may be produced by one or more electromagnets.

The one or more electromagnets may include two or more electromagnets and the magnetic field may be applied alternately to the vessel by each of the two or more electromagnets.

The method may further include inputting the non-dispersed carbon nanotube agglomerate back into the vessel for repeating the dispersion process again.

The method may be performed using the device of claim 1.

In another general aspect, a device for separating dispersed carbon nanotubes from a non-dispersed carbon nanotube agglomerate includes a vessel; a first outlet of the vessel configured to receive the dispersed carbon nanotubes; a second outlet of the vessel configured to receive the non-dispersed carbon nanotube agglomerate; and a magnet.

The magnet may be an electromagnet that is placed on a side of the vessel.

The first outlet may be positioned farther from the electromagnet than the second outlet.

The electromagnet may be configured to attract the non-dispersed carbon nanotube agglomerate to a greater degree than the dispersed carbon nanotubes.

The electromagnet may be configured to attract the non-dispersed carbon nanotube agglomerate and the dispersed carbon nanotubes based on a quantity of magnetic particles attached to each of the non-dispersed carbon nanotube agglomerate and the dispersed carbon nanotubes.

BRIEF DESCRIPTION OF THE DRAWINGS

FIG. 1 is a diagram illustrating an example of a size sorting device.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

In one example, a size sorting device for carbon nanotube agglomerate includes a vessel 100 which is not affected by a magnetic field. The vessel includes an inlet part 110 placed at an upper portion and used to introduce a mixed liquid containing the carbon nanotube agglomerate having a magnetic particle, a first collection part 120 placed at a lower portion of the vessel facing the inlet part and used to separate dispersed carbon nanotubes and collect the same, a second collection part 130 placed at a lower portion of the vessel facing the inlet part and used to collect a non-dispersed carbon nanotube agglomerate, and two or more electromagnets 210 placed at an external wall surface at one side of the vessel. The mixed liquid containing the carbon nanotube agglomerate having the magnetic particle attached thereto may be subjected to a dispersion process before being introduced into the vessel 100.

In an example, the first collection part 120 may be placed to face the electromagnets 210. FIG. 1 is a diagram illustrating an example of the size sorting device. Referring to FIG. 1, since dispersed carbon nanotubes are hardly affected by a magnetic field, they are discharged out and collected through the first collection part 120 placed to face the electromagnets. However, this example is not limited thereto.

After the magnetic particle is attached to the surfaces of the carbon nanotube agglomerate, the carbon nanotube agglomerate is mixed with a fluid and subjected to a dispersion process. After the dispersion process, the mixed liquid containing the carbon nanotube agglomerate having the magnetic particle attached thereto is put into the size sorting device. Then, if a magnetic field is applied repeatedly, the carbon nanotube agglomerate may be crushed into a small agglomerate and finally dispersed into individual carbon nanotubes. At this time, the carbon nanotube agglomerate which is yet to be completely dispersed needs to be returned back into the dispersion process for the application of the magnetic field, whereas completely dispersed carbon nanotubes need to be separated from the non-dispersed carbon nanotube agglomerate and collected. In this example, the non-dispersed carbon nanotube agglomerate which have a large size and a large amount of magnetic particles attached thereto are attracted by the magnetic field and guided into a transfer path, i.e., the second collection part 130.

The mixed liquid containing the carbon nanotube agglomerate is moved slowly from an upper end of the vessel to a lower end thereof. While the mixed liquid is being moved, a magnetic field is applied by the two or more electromagnets 210 alternately by an electric current applied from a magnetic field application device which adjusts the strength of the magnetic field. As a result, a carbon nanotube agglomerate having a large size and which is yet to be completely dispersed is attracted by the magnetic field into the second collection part 130 directly underneath, whereas the dispersed carbon nanotubes are discharged into the first collection part 120. Accordingly, the non-dispersed carbon nanotube agglomerates and the dispersed carbon nanotubes can be sorted by their sizes.

In an example, the non-dispersed carbon nanotube agglomerate collected through the second collection part 130 may be supplied into the inlet part 110 again after being subjected to a dispersion process in which the non-dispersed carbon nanotube agglomerate is mixed with a fluid. If a magnetic field is applied by the electromagnets, non-dispersed carbon nanotube agglomerates in the mixed liquid containing carbon nanotube agglomerates with magnetic particles attached thereto may cling to a wall surface of the vessel on the side where the electromagnets are provided as a result of the attractive force of the magnetic field. Then, if the magnetic field disappears, the non-dispersed carbon nanotube agglomerates may fall directly downwards and be discharged into and collected by the second collection part 130. Then, the non-dispersed carbon nanotube agglomerate may be returned back into the inlet part 110 to be subjected to a dispersion process again.

The vessel 100 may not be particularly limited as long as it is made of a material which is not affected by a magnetic field. For example, the vessel 100 may be made of, glass, quartz, metal oxide, ceramic, polymer, polymer complex, carbon material, rock or metal-containing material other than materials containing a metal having strong magnetism in a magnetic field, etc. Nevertheless, the material of the vessel is not limited thereto.

Any number of electromagnets 210 may be used; for example, the number of the electromagnets 210 may be one, two, or more. In an example, a magnetic field may be applied to the vessel using two or more electromagnets in an alternative manner. If the two or more electromagnets are vertically arranged and the magnetic field is applied from the electromagnets alternately, a carbon nanotube agglomerate yet to be completely dispersed may cling to the wall surface of the vessel at one side due to a magnetic field produced by the uppermost electromagnet. Once this magnetic field disappears, the non-dispersed carbon nanotube agglomerate may fall directly downwards and sink down thus moving towards the next electromagnet from which a magnetic field is applied. The non-dispersed carbon nanotube agglomerate may undergo this process repeatedly as much as the number of electromagnets which are arranged. The number and process of using the electromagnet or electromagnets is not limited thereto.

In another example, there is provided a method for separating and collecting dispersed carbon nanotubes by using the size sorting device for carbon nanotube agglomerate.

In this example, a method of separation includes attaching magnetic particles to a carbon nanotube agglomerate by mixing the carbon nanotube agglomerate having the magnetic particle attached thereto with a fluid in order to prepare a mixed solution, dispersing the carbon nanotube agglomerate in the mixed liquid, introducing the mixed liquid, which has undergone a dispersion process into the vessel by the inlet part of the size sorting device, and collecting dispersed carbon nanotubes by the first collection part 120 while collecting non-dispersed carbon nanotube agglomerate by the second collection part 130. The separation between the dispersed carbon nanotubes and non-dispersed carbon nanotubes occurs through size sorting using a magnetic field.

For example, the fluid may include a member selected from the group consisting of water, alcohols, organic solvents, surfactant-containing aqueous solution, glycerin, low-viscosity polymer, and combinations thereof, but is not limited thereto. The magnetic particle may include a transition metal oxide, but is not limited thereto. The transition metal oxide may include a member selected from the group consisting of iron oxide, cobalt oxide, nickel oxide, chrome oxide, magnetite, and combinations thereof, but is not limited thereto.

In the mixed liquid containing the carbon nanotube agglomerate to which the magnetic particle are bonded, the magnetic particles may be included in an amount ranging from about 0.1 part by weight to about 20 parts by weight with respect to about 1 part by weight of the carbon nanotube agglomerate,. By way of example, the amount of the magnetic particle with respect to about 1 part by weight of the carbon nanotube agglomerate in the mixed solution of the carbon nanotube agglomerates may be in the range of from about 0.1 part by weight to about 20 parts by weight, from about 0.5 part by weight to about 20 parts by weight, from about 1 part by weight to about 20 parts by weight, from about 2 parts by weight to about 20 parts by weight, from about 5 parts by weight to about 20 parts by weight, from about 10 parts by weight to about 20 parts by weight, from about 0.1 part by weight to about 10 parts by weight, from about 0.1 part by weight to about 5 parts by weight, from about 0.1 part by weight to about 2 parts by weight, from about 0.1 part by weight to about 1 part by weight, from about 0.1 part by weight to about 0.5 part by weight, or from about 2 parts by weight to about 5 parts by weight. Nevertheless, the ratio of the magnetic particle with respect to the carbon nanotube is not limited thereto.

The magnetic field may be produced by two or more electromagnets and may be applied to the vessel by the two or more electromagnets alternately. If the two or more electromagnets are vertically arranged and the magnetic field is applied from the electromagnets alternately, a carbon nanotube agglomerate yet to be completely dispersed may cling to a wall surface of the vessel at one side owing to a magnetic field of the uppermost electromagnet. Once this magnetic field disappears, the non-dispersed carbon nanotube agglomerate may fall directly downwards and sink down towards the next electromagnet from which a magnetic field is applied. The non-dispersed carbon nanotube agglomerate may undergo this process repeatedly as much as the number of electromagnets that are arranged, but the separation process is not limited thereto.

In an example, the dispersed nanotubes may be preferentially collected. Also, in accordance with an example, the method may further include inputting the non-dispersed carbon nanotube agglomerate having a large size back into the dispersion process again.

In a conventional method using a ball mill, a ultrasonic wave, a roll mill, or the like, an unnecessary force may applied to dispersed carbon nanotubes resulting in deterioration of the quality of the carbon nanotubes. According to various aspects of the method for separating carbon nanotube, already dispersed carbon nanotubes can be preferentially collected and the dispersion process can be continuously performed only on carbon nanotube agglomerate yet to be completely dispersed.

An example of the present disclosure will be described in further detail. However, it should be appreciated by those skilled in the art that the present examples are not limited thereto.

The size sorting device as described above was installed, and an experiment for carbon nanotube dispersion was conducted as follows. In this example, prior to separating carbon nanotubes, magnetic particles are attached to carbon nanotubes by using a radical initiator adhesion method. Magnetite particles in weight percent three times as high as that of multi-walled carbon nanotubes (MWNTs) were added to 100 mL of distilled water in which 1.5 g of 4,4'-azobis(4-cyanovaleric acid) (hereinafter, referred to as "V-501") was dissolved. Then, by injecting a nitrogen gas at 80° C. for 10 hours, the magnetic particles are attached to surfaces of the carbon nanotubes. After adding NMP (N-methyl-2 pyrrolidone) to the carbon nanotube-magnetite complex in which carbon nanotube agglomerates and the magnetic particles are bonded at a weight ratio of 1:3, the carbon nanotube-magnetite complex was subjected to a physical dispersion process. Upon the completion of the physical dispersion process, the mixed liquid of the carbon nanotube-magnetite complex was transferred into the size sorting device. After the mixed liquid was introduced into the size sorting device, by applying a magnetic field of 1 T to the electromagnets at an interval of 2 seconds for 8 hours, carbon nanotubes were dispersed.

Through this magnetic field application process, non-dispersed carbon nanotube agglomerates having large sizes were attracted by a magnetic attractive force and discharged into the second collection part, whereas dispersed carbon nanotubes hardly affected by the magnetic field were discharged into the first collection part. As a result, the non-dispersed carbon nanotube agglomerates and the dispersed carbon nanotubes were collected separately.

In this example, the carbon nanotube agglomerates having large sizes that have passed through the second collection part were returned back to the dispersion process and made to pass through the size sorting device again. This resulted in only dispersed carbon nanotubes being collected. This example describes passing the separated carbon nanotube agglomerates through the size sorting device once more; however, it should be appreciated that the separated agglomerates may be passed through the size sorting device again any number of times.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A device for sorting a carbon nanotube agglomerate, comprising:

a vessel comprising, an inlet disposed at an upper portion of the vessel;

a chamber to separate dispersed carbon nanotubes from non-dispersed carbon nanotube agglomerate;

a first collection part disposed below the chamber and configured to collect dispersed carbon nanotubes supplied via a first outlet disposed below the chamber;

a second collection part disposed below the chamber and configured to collect non-dispersed carbon nanotube agglomerate material supplied via a second outlet disposed below the chamber; and one or more electromagnets placed at an external wall surface of the vessel.

2. The device of claim 1, wherein the first collection part is disposed to face the one or more electromagnets.

3. The device of claim 1, wherein the vessel is made of glass, quartz, metal oxide, ceramic, polymer, polymer complex, carbon material, rock or a metal-containing material which is not magnetized when placed in a magnetic field.

4. The device of claim 1, wherein the one or more electromagnets comprise two or more electromagnets that are configured to alternately apply a magnetic field to the vessel.

5. The device of claim 1, wherein the vessel is not affected by a magnetic field; and the inlet is configured to introduce into the vessel a mixed solution containing the carbon nanotube agglomerate having a magnetic particle attached thereto wherein the mixed solution is subjected to a dispersion process prior to being introduced into the vessel.

6. The device of claim 1, wherein the first outlet is disposed at an angle to a bottom and a side of the chamber and is disposed facing the chamber and the second outlet is disposed orthogonal to the bottom of the chamber and is disposed facing the inlet and the chamber.

7. A device for separating dispersed carbon nanotubes from a non-dispersed carbon nanotube agglomerate, comprising:

a vessel comprising, an inlet;

a chamber disposed below the inlet;

a first outlet disposed below the chamber configured to receive the dispersed carbon nanotubes; and a second outlet disposed below the chamber configured to receive the non-dispersed carbon nanotube agglomerate; and a magnet, wherein the first outlet is positioned farther from the magnet than the second outlet.

8. The device of claim 7, wherein the magnet is an electromagnet that is placed on a side of the vessel.

9. The device of claim 7, wherein the electromagnet is configured to attract the non-dispersed carbon nanotube agglomerate to a greater degree than the dispersed carbon nanotubes.

10. The device of claim 7, wherein the electromagnet is configured to attract the non-dispersed carbon nanotube agglomerate and the dispersed carbon nanotubes based on a quantity of magnetic particles attached to each of the non-dispersed carbon nanotube agglomerate and the dispersed carbon nanotubes.

* * * * *